US005954410A

United States Patent [19]

Noellert

[11] Patent Number: 5,954,410

[45] Date of Patent: Sep. 21, 1999

[54] SUSPENDED CEILING STORAGE UNIT

[76] Inventor: Larry L. Noellert, 37281 Glenbrook, Clinton Township, Macomb County, Mich. 48036

[21] Appl. No.: 09/005,732

[22] Filed: Jan. 12, 1998

[51] Int. Cl.[6] ..... A47B 67/02

[52] U.S. Cl. ..... 312/242; 52/32

[58] Field of Search ..... 312/245, 246, 312/247, 248, 204, 237, 242, 243, 329, 249.7, 334.12, 330.1, 334.42; 52/29, 32, 37, 36.4, 36.5, 36.1; 211/64

[56] References Cited

U.S. PATENT DOCUMENTS

| | | | |
|---|---|---|---|
| 119,962 | 10/1871 | Breed | 312/248 |
| 3,331,645 | 7/1967 | Vercellotti | 312/248 |
| 3,485,544 | 12/1969 | Beckerman | 312/248 |
| 4,485,928 | 12/1984 | Staashelm | 211/35 X |
| 4,699,437 | 10/1987 | Genereaux | 312/248 |
| 5,407,261 | 4/1995 | Mercer | 312/248 |
| 5,595,028 | 1/1997 | Handzlik | 52/32 |
| 5,772,295 | 6/1998 | Sundmark | 312/246 |
| 5,788,349 | 8/1998 | DeMaine et al. | 312/223.6 X |

*Primary Examiner*—Milton Nelson, Jr.
*Assistant Examiner*—Brian H. Buck
*Attorney, Agent, or Firm*—Peter D. Keefe

[57] ABSTRACT

A storage unit for articles which is interfaced with a suspended ceiling, wherein the articles are stored above the suspended ceiling, yet readily accessible whenever they are needed. The suspended ceiling storage unit includes an outer frame which is dimensioned to rest upon the support lips of the runners of a rectilinear opening of the suspended ceiling, and an inner frame which is pivotably connected with the outer frame and is nestable therewith in a common plane. The inner frame has a lower flange for supporting a ceiling panel, and further has connected thereto a storage member for holding articles. The preferred storage member is a peg board and its interfaced pegs. In operation, a user places the storage unit into a selected rectilinear opening of a suspended ceiling, whereupon the outer frame rests upon the support lips of the adjoining runners. The inner frame is pivoted down for accessing articles with respect to the storage member, and the suspended ceiling storage unit is not noticeable to a casual onlooker when in the up position.

15 Claims, 3 Drawing Sheets

SUSPENDED CEILING STORAGE UNIT

BACKGROUND OF THE INVENTION

1. Field of the invention

The present invention relates to suspended ceilings, wherein a plurality of ceiling panels are supported via a plurality of rectilinearly arranged T-shaped runners that are, themselves, suspendably supported from an overhead building structure. More particularly, the present invention relates to a selectively accessible storage unit which is placed at a ceiling panel absent rectilinear opening and is supported on the adjoining runners.

2. Description of the Prior Art

Suspended ceilings (also sometimes referred to as "drop ceilings") have become a ubiquitous feature of many buildings because of their beautiful look, ease of installation, and simplicity of servicing of parts thereof. Suspended ceilings are composed of a plurality of T-shaped runners having a horizontal member and a vertical member bisectionally connected to the horizontal member. On either side of the vertical member, the horizontal member provides a support lip. The vertical member has a plurality of spaced holes therealong for engaging suspension rods, frequently in the form of thick copper wires. In this regard, one end of the suspension rods is engaged with an overhead building structure, while the other end passes through a respective hole, the suspension rods being twisted back on themselves above the runner to thereby securely suspend the runner. Runners at the wall are usually L-shaped, having a horizontal member in the form of a support lip and a vertical member which is nailed directly to the wall at the same height as that of the suspended runners.

The runners are usually of two kinds, main runners which are suspendably connected to the suspension rods, and cross runners which engage the main runners by a tab and slot arrangement. The combination of the main and cross runners form a pattern of rectilinear openings across the ceiling of a room or hall placed into each of the rectilinear openings is a ceiling panel, which is supported upon the support lip of the runners adjoining that rectilinear opening. The underside of the horizontal member of the runners is colored to pleasingly match the color of the ceiling panels, thereby rendering an overall pleasing look to the completed ceiling.

Frequently, one of the greatest problems with living spaces is sufficient room for the storage of articles. Since a considerable "wasted" space lies above a suspended ceiling, it would be very desirable if somehow the space above a suspended ceiling could be used for the storage of articles.

SUMMARY OF THE INVENTION

The present invention is a storage unit for articles which is interfaced with a suspended ceiling, wherein the articles are stored above the suspended coiling, yet are readily accessible whenever they are needed.

The suspended ceiling storage unit according to the present invention includes an outer frame which is dimensioned to rest upon the support lips of the runners of a rectilinear opening of the suspended ceiling. An inner frame is hingably connected with the outer frame and is nestable therewith in a common plane. The inner frame has a lower flange for supporting a ceiling panel, and a storage member for holding articles is connected thereto.

The preferred storage member is a peg board and its interfaced pegs. The preferred hinge is a piano hinge. Opposite the hinge, the inner frame carries at least one connector, preferably two connectors, which are engageable with the outer frame so as to selectively hold the inner frame in the plane of the outer frame.

In operation, a user removes the ceiling panel from a selected rectilinear opening of a suspended ceiling (or simply omits placing a ceiling panel thereat). The user then cuts the removed ceiling panel (or another ceiling panel) so that it will fit restably upon the lower flange of the inner frame and then places the ceiling panel thereupon. The user next installs the storage member onto the inner frame. Lastly, the user places the suspended ceiling storage unit into the rectilinear opening, whereupon the outer frame rests upon the support lips of the adjoining runners.

Now, the user releases the connectors with respect to the outer frame, and then lets the inner frame rotate downwardly on the hinge to a more or less vertical attitude. Articles are now placed onto the storage unit, and the inner frame is then rotated back into the plane of the outer frame, whereupon the connectors are again engaged with the outer frame. Later on, if the user needs to remove articles, or add additional articles, the inner frame is rotated down and then back up as desired.

Accordingly, it is an object of the present invention to provide a storage unit for articles, wherein the articles' storage is provided in the space above a suspended ceiling.

It is an additional object of the present invention to provide a storage unit which interfaces with a conventional suspended ceiling, wherein an articles supporting portion thereof is rotatable from an up position that provides a look resembling the remainder of the suspended ceiling to a down position that allows access to stored articles.

These, and additional objects, advantages, features and benefits of the present invention will become apparent from the following specification.

DETAILED DESCRIPTION OF THE PREFERRED EMBODIMENT

Figure 1:
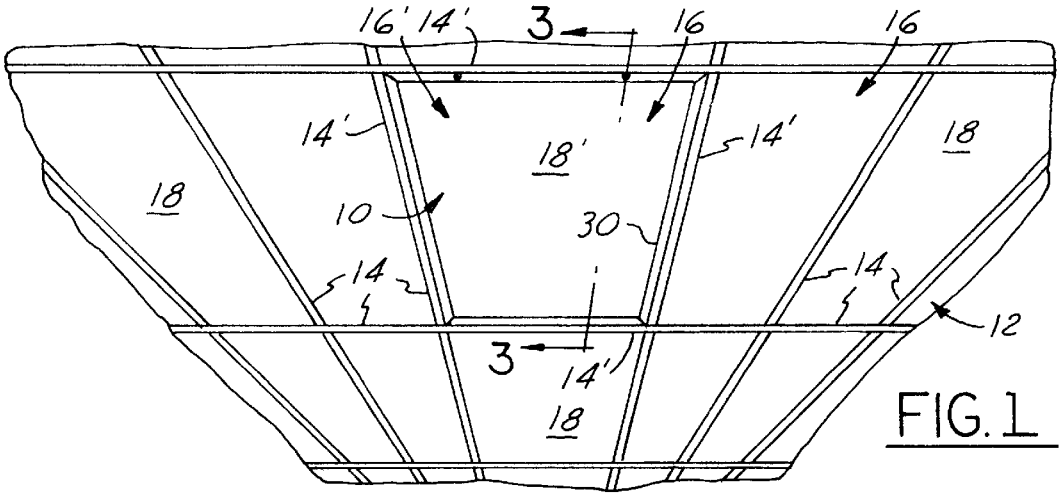
FIG. 1 is a broken-away perspective view of a suspended ceiling which includes the suspended ceiling storage unit according to the present invention shown in the up position.
Figure 2:
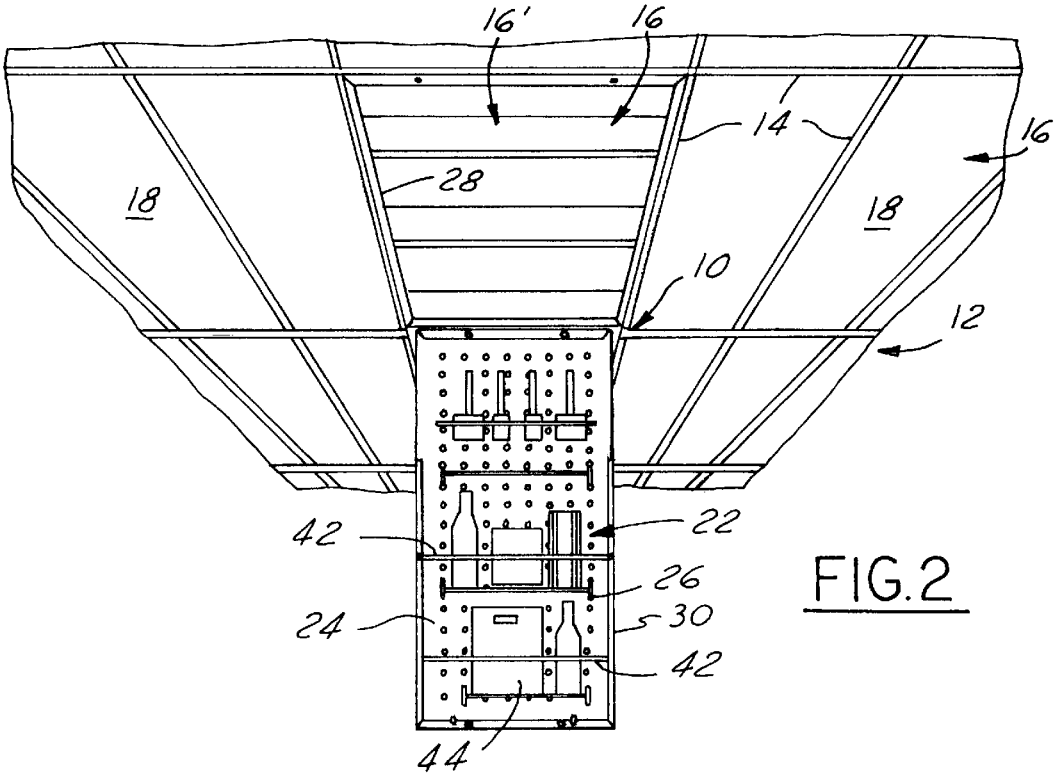
FIG. 2 is a broken-away perspective view as in FIG. 1, wherein the ceiling storage unit is shown in the down position.

Referring now to the drawing, FIGS. 1 and 2 depict the suspended ceiling storage unit 10 according to a preferred embodiment of the present invention in operation with respect to a conventional suspended ceiling 12. The suspended ceiling 12 includes a plurality of rectilinearly arranged runners 14 forming a plurality of rectilinear openings 16 into which are received ceiling panels 18. In this regard, the runners 14 have support lips 20 (see FIG. 3) upon which the ceiling panels 18 supportably rest. One of the ceiling panels is removed from (or not installed at) a selected rectilinear opening 16' and in its place the suspended ceiling storage unit 10 is placed restably upon the support lips 20' of the adjoining runners 14'.

The suspended ceiling storage unit 10 includes an outer frame 28 which is structured to rest upon the support lips 20', and further includes an inner frame 30 which carries a storage member 22. The inner frame 30 is pivotable with respect to the outer frame 28, wherein at an up position (as shown at FIG. 1) the inner frame is parallel to the plane of the suspended ceiling 12, and at a down position (as shown at FIG. 2) the inner frame is substantially perpendicular to the plane of the suspended ceiling. When at the up position, the suspended ceiling storage unit 10 blends perfectly with the suspended ceiling and is essentially not noticeable to the casual onlooker in that a ceiling panel 18' is located at the underside of the inner frame 30. At the upperside of the inner frame 30, articles are stored by the storage member 22, such as for example via pegs 26 interfaced with a peg board 24. The storage member 22 is accessible whenever the inner frame 30 is at the down position.

Consequently, it is to be understood that the suspended ceiling storage unit 10 provides an essentially hidden structure for storing articles in the space above a suspended ceiling, wherein the articles are very easily accessed as needed.

The structure and function of the suspended ceiling storage unit 10 will now be detailed with greater specificity, with reference being additionally directed to remaining FIGS. 3 through 8.

Figure 3:
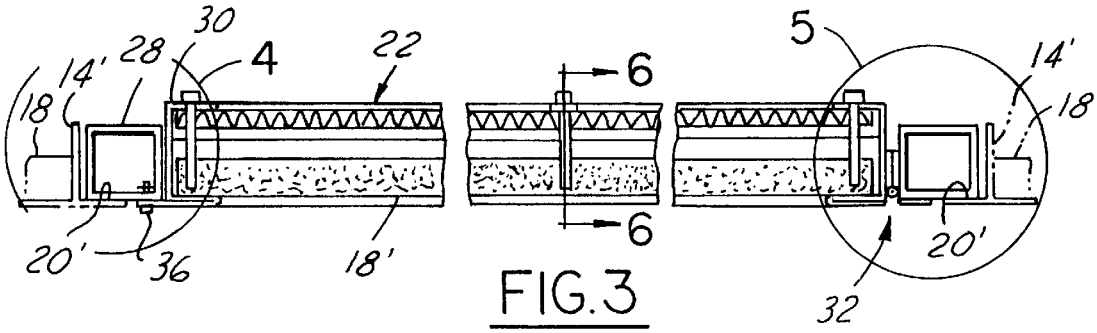
FIG. 3 is a partly broken-away side view of the ceiling storage unit according to the present invention.
Figure 5:
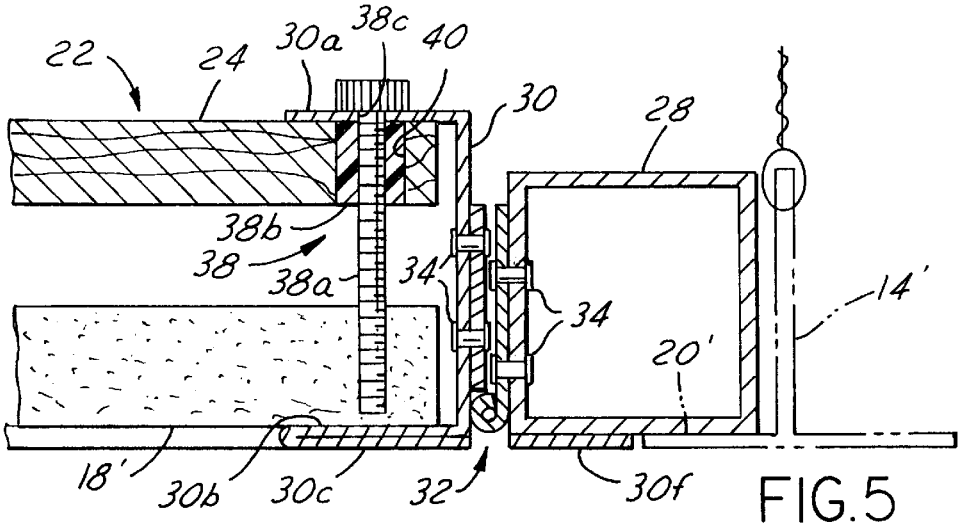
FIG. 5 is a partly sectional side view of the ceiling storage unit according to the present invention, seen at circle 5 of FIG. 3.
Figure 6:
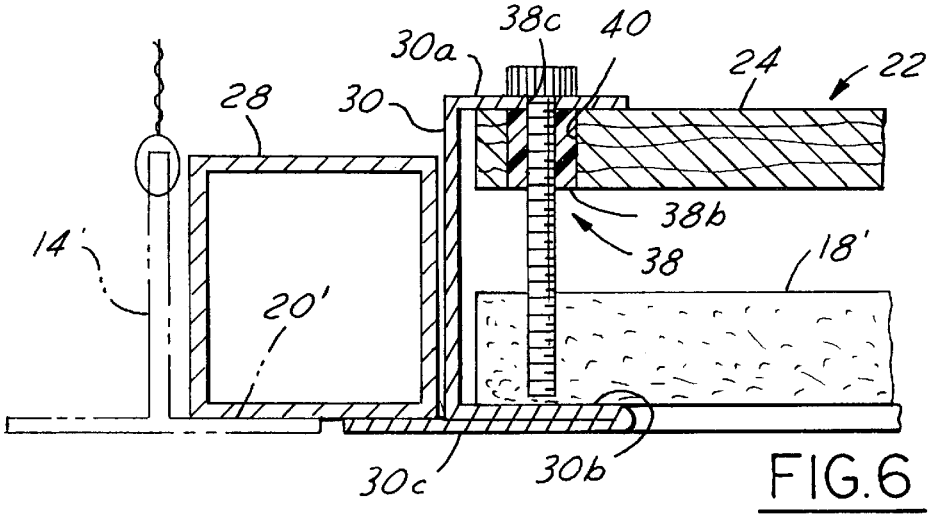
FIG. 6 is a partly sectional side view of the ceiling storage unit according to the present invention, seen along line 6 in FIG. 3.
Figure 7:
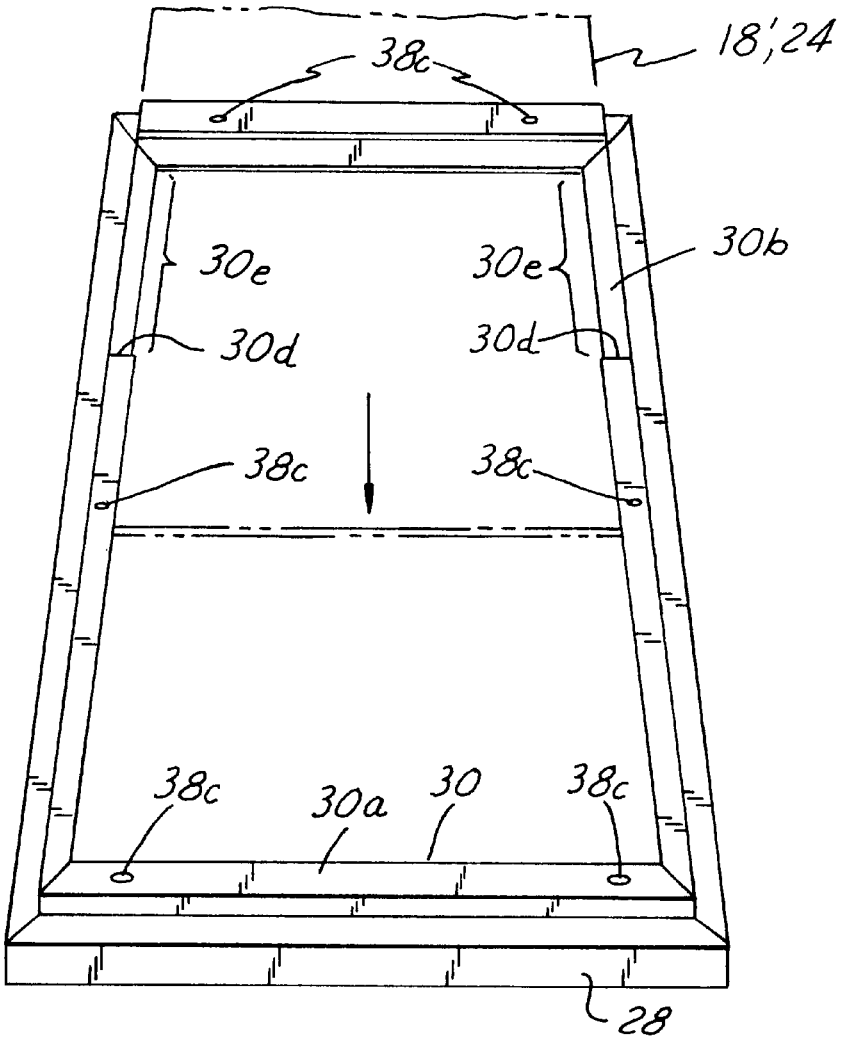
FIG. 7 is a perspective view of the inner and outer frames of the ceiling storage unit according to the present invention.

As best shown at FIGS. 3 and 7, the suspended ceiling storage unit 10 includes the aforementioned outer and inner frames 28, 30, wherein the inner frame is nestable with respect to the outer frame. As shown at FIG. 5, the inner frame 30 is connected at a first end thereof to the outer frame 28 via a hinge 32, such as for example a piano hinge connected thereto by rivets 34.

Figure 4:
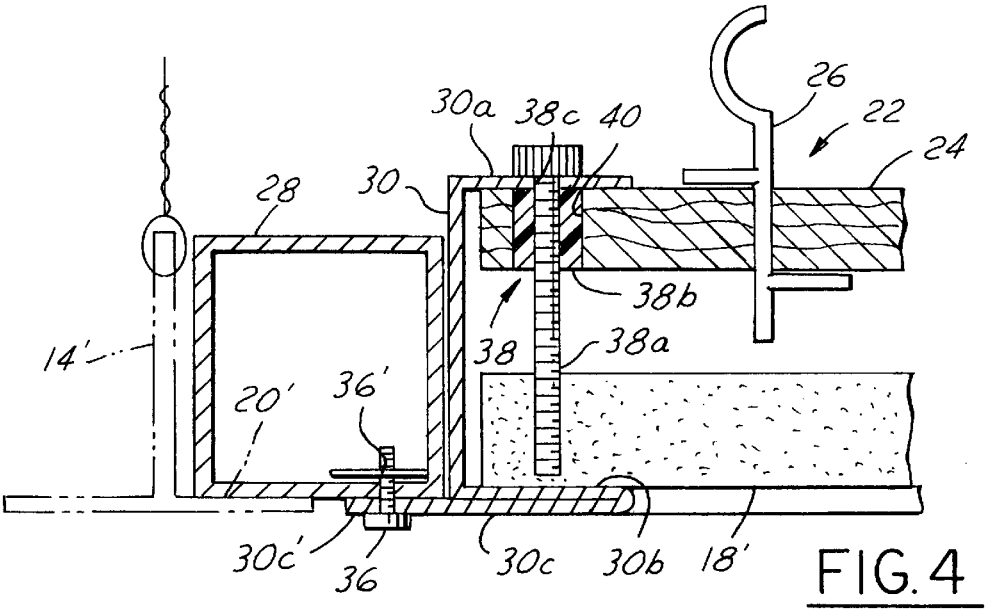
FIG. 4 is a partly sectional side view of the ceiling storage unit according to the present invention, seen at circle 4 of FIG. 3.

As best shown at FIG. 4, a pair of connectors 36, such as for example twist-type threaded fasteners used for holding the bezel of suspended ceiling fluorescent light fixtures, are permanently affixed to the inner frame and are threadeably engageable with threaded holes 36' of the outer frame 28. When engaged, the connectors 36 cooperate with the hinge 32 to hold the inner frame 30 to the outer frame 28 in a common plane. Accordingly, by disengaging the connectors 36, the inner frame 30 is freely pivotable on the hinge 32 between the up and down positions.

It is preferred for the outer frame 28 to have a square cross-section and be of unitized construction in the form of a rectilinear shape that is sized to be seatable upon the support lips 20' of the adjoining runners 14' at the selected rectilinear opening 16' of the suspended ceiling 12.

It is preferred for the inner frame 30 to be generally U-shaped in a direction facing away from the outer frame 28 and of a unitized construction which nests into the outer frame. The U-shape of the inner frame 30 includes an upper flange 30*a* and a lower flange 30*b*. An underside portion 30*c* of the inner frame 30 is finished to match the finish of the runners 14, 14' of the suspended ceiling 12. As shown at FIG. 4, an extension 30*c'* of the underside portion 30*c* carries the connectors 36.

To customize the suspended ceiling storage unit 10 so that it matches the look of the suspended ceiling, a ceiling panel 18' that is identical with the other ceiling panels 18 is cut so as to be fitted into the inner frame 30 and be supportably resting upon the lower flange 30*b*.

The storage member 22 is connected with the inner frame 30, whereby when the inner frame is pivoted on the hinge 32, the storage member also pivots in unison. The storage member 22 is connected to the inner frame 30 via fasteners. In this regard by way of a preferred example, the peg board 24 is located between the upper and lower flanges 30*a*, 30*b* via threaded fasteners 38. The threaded fasteners 38 are preferably in the form of a bolt 38*a* that passes through a hole 38*c* in the upper flange and a threaded washer 38*b* which is connected with the peg board 24. A preferable threaded washer 38*b* is composed of an elastomeric material which is press-fit into a washer hole 40 formed in the peg board 24. It is preferred for six threaded fasteners 38 to be used, although the number could be greater or lesser than six.

In order to locate the ceiling panel 18' and the peg board 24 between the upper and lower flanges 30*a*, 30*b* of the inner frame 30, it is preferred for the upper flange to have truncations 30*d*, whereby there is a flange absence 30*e* of the upper flange between the truncations and the portion of the upper flange at the side of the inner frame which connects to the hinge 32. As shown at FIG. 7, the flange absence 30*e* provides a space through which the ceiling panel 18' and the peg board 24 is passed into a seated placement between the upper and lower flanges 30*a*, 30*b*.

While not required, a facia trim piece 30*f* may be provided on the outer frame 28 adjacent the hinge 32 so that there is an apparent harmony of appearance when an onlooker compares the extension 30*c'* thereto.

By way of example only, the following structural aspects are preferred. The outer and inner frames are constructed of aluminum. The outer frame has a square cross-section measuring about one inch by one inch. The inner frame is fabricated from flat stock.

Figure 8:
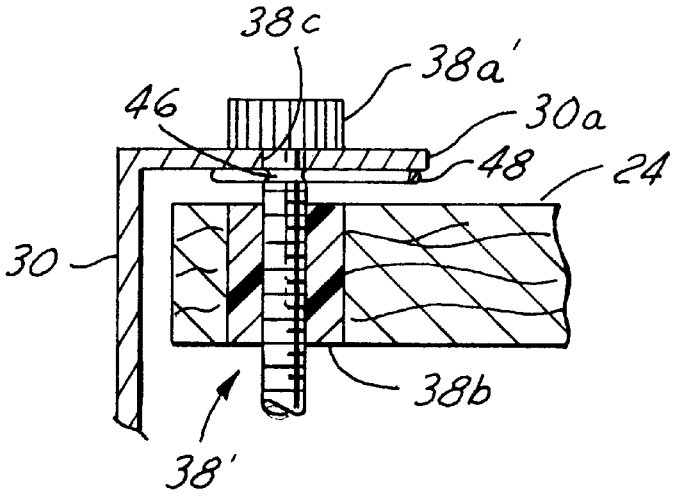
FIG. 8 is a detail, partly sectional view of an alternative thread fastener which provides for adjustment of location of a support member with respect to the inner frame.

Finally, FIG. 8 shows an example of threaded fasteners 38' which provide selective location of the peg board 24 with respect to the inner frame 30. In this regard, the bolt 38*a'* has a slot 46 into which is releasably interfaced a U-shaped spring-loaded pin 48. Consequently, when the bolt 38*a'* is rotated the pin 48 keeps the head located at the upper flange 30*a* while the threaded washer 38*b* threads on the bolt and the peg board 24 moves in relation to the inner frame 30. Other suitable structures known in the mechanical art to hold the head of the bolt at the upper flange may equally be used. An example of a reason to provide selective positioning of the peg board relative to the inner frame is so that the pegs can be brought into contact with the ceiling panel to thereby reduce their looseness.

In operation, a user selects a desired rectilinear opening 16' for placement therein of the suspended ceiling storage unit 10. A ceiling panel 18' is then cut so as to be sized to restably lay upon the lower flange 30*b* of the inner frame 30. The ceiling panel is then passed through the flange absence 30*e* and allowed to rest upon the lower flange. Next, the storage member 22 is installed. In this regard for example, a peg board 24 is passed through the flange absence and then while lying in the space between the ceiling panel and the upper flange, the bolts 38*a* are threaded onto the threaded washers 38*b* until the peg board is separated from the ceiling panel enough to allow the pegs 26 to be placed into the peg board without hurting the ceiling panel. Preferably, the peg board is tightly affixed against the upper flange by the threaded fasteners 38. The bolts will preferably extend long enough to penetrate the ceiling panel and thereby secure it to the inner frame. The pegs 26 are now installed upon the peg board. Lastly, with the connectors 36 engaged so as to hold the outer and inner frames 28, 30 in a common plane, the outer frame is placed upon the support lips 20' of the adjoining runners 14'.

The connectors are now released and the inner frame is allowed to pivot downwardly from the plane of the suspended ceiling. Articles 44 are now placed upon the article holding structures of the pegs. Optionally, elastic straps or bungee cords 42 are interfaced with the peg board 24 so to assist holding the articles 44 onto the peg board.

To those skilled in the art to which this invention appertains, the above described preferred embodiment may be subject to change or modification. For example, the storage member may be other than a peg board and pegs, such as for example a cabinet with drawers or a series of shelves. And, it is to be further noted that the structural aspects of the inner and outer frames are merely presented in a preferred form, and are subject to wide design variation by those of ordinary skill in the art when carrying out the invention as described herein. Such change or modification can be carried out without departing from the scope of the invention, which is intended to be ignited only by the scope of the appended claims.

What is claimed is:

1. In a suspended ceiling comprising a plurality of runners forming a plurality of rectilinear openings, the runners having support lips, the suspended ceiling further comprising a plurality of ceiling panels which rest upon the support lips adjoining respective rectilinear openings, an improvement thereto comprising a storage unit restably interfaceable upon the runners thereof, said storage unit comprising:

frame means for being restably supported upon the support lips of runners respectively adjoining a selected rectilinear opening of the suspended ceiling; and storage means for holding articles, said storage means being pivotally connected with respect to said frame means.

2. The suspended ceiling of claim 1, wherein said storage means further comprises an inner frame pivotally connected with said frame means, said inner frame having a lower flange capable of supporting a selectively trimmed ceiling panel of the suspended ceiling, wherein said storage means is pivotable between an up position and a down position;

wherein said storage unit further comprises means for selectively holding said storage means at said up position; wherein when said storage means is at said up position the lower flange is substantially aligned in a plane with the plurality of runners of the suspended ceiling.

3. The suspended ceiling of claim 2, wherein said storage means comprises a peg board comprising a planar member having a multiplicity of holes and a plurality of pegs connectable therewith via the holes.

4. The suspended ceiling of claim 3, wherein said inner frame has an upper flange disposed opposite said lower flange, said storage unit further comprising connection means for connecting said peg board to said inner frame, said connection means comprising a plurality of threaded fasteners engaged with respect to said upper flange and said peg board.

5. The suspended ceiling of claim 4, wherein each threaded fastener of said plurality of threaded fasteners comprises a bolt and an elastomeric washer, wherein the bolt passes through a hole in the upper flange and the washer is press-fit into a hole in the peg board.

6. The suspended ceiling of claim 5, wherein said connection means provides selective placement of said peg board with respect to said upper flange.

7. The storage unit of claim 6, wherein said connection means comprises at least one twist-type threaded fastener which is installed on said lower flange and threadably engageable with said outer frame.

8. The suspended ceiling of claim 2, wherein the pivotal connection of said storage means with respect to said frame means comprises a piano hinge.

9. The suspended ceiling of claim 2, wherein said inner frame has an upper flange disposed opposite said lower flange and which is truncated to thereby provide a flange absence through which a ceiling panel is capable of being passed so as to be restable upon said lower flange.

10. A storage unit for being interfaced with a suspended ceiling, the suspended ceiling having a plurality of runners forming rectilinearly shaped openings, the runners having support lips, the suspended ceiling further having a plurality of ceiling panels which rest upon the support lips adjoining the rectilinear openings, said storage unit comprising:

an outer frame having a rectilinear shape for being restably supported upon support lips of runners adjoining a selected rectilinear opening of a suspended ceiling;

an inner frame nestable with respect to said outer frame, said inner frame having an underside and an opposite upperside;

hinge means for pivotally connecting said inner frame to said outer frame, wherein said inner frame is pivotable between an up position whereat said inner frame is nested with respect to said outer frame in a plane of said outer frame and a down position whereat said inner frame is oriented divergent with respect to said plane;

connector means for releasably connecting said inner frame to said outer frame wherein said connector means cooperates with said hinge means to hold said inner frame at said up position;

storage member means for holding articles with respect to said inner frame; and connection means for connecting said storage member means to said inner frame;

wherein said storage member means comprises a peg board and a plurality of pegs connectable therewith;

wherein said inner frame has an upper flange at said upperside thereof, said connection means comprising a plurality of threaded fasteners engaged with respect to said upper flange and said peg board; and wherein each threaded fastener of said plurality of threaded fasteners comprises a bolt and an elastomeric washer, wherein the bolt passes through a hole in the upper flange and the washer is press-fit into a hole in the peg board.

11. The storage unit of claim 10, wherein said inner frame has a lower flange for supporting a ceiling panel at said underside thereof.

12. The storage unit of claim 11, wherein said hinge means comprises a piano hinge.

13. The storage unit of claim 12, wherein said connector means comprises at least one twist-type threaded fastener which is installed on said lower flange and threadably engageable with said outer frame.

14. The storage unit of claim 13, wherein said upper flange is truncated to thereby provide a flange absence through which the ceiling panel is capable of being passed so as to be restable upon said lower flange.

15. The storage unit of claim 14, wherein said connection means provides selective placement of said peg board with respect to said upper flange.

* * * * *